US011851261B2

(12) United States Patent
Doux et al.

(10) Patent No.: US 11,851,261 B2
(45) Date of Patent: Dec. 26, 2023

(54) LIQUID CONTAINER

(71) Applicant: FLEXIKEG SAS, Paris (FR)

(72) Inventors: Jean-Christophe Doux, Paris (FR); Anas Binebine, Paris (FR)

(73) Assignee: FLEXIKEG SAS, Paris (FR)

( * ) Notice: Subject to any disclaimer, the term of this patent is extended or adjusted under 35 U.S.C. 154(b) by 0 days.

(21) Appl. No.: 17/259,956

(22) PCT Filed: Jul. 18, 2019

(86) PCT No.: PCT/EP2019/069432
§ 371 (c)(1),
(2) Date: Jan. 13, 2021

(87) PCT Pub. No.: WO2020/020753
PCT Pub. Date: Jan. 30, 2020

(65) Prior Publication Data

US 2021/0269221 A1 Sep. 2, 2021

(30) Foreign Application Priority Data

Jul. 27, 2018 (FR) ..... 1870875

(51) Int. Cl.
*B65D 81/20* (2006.01)
*B65D 85/72* (2006.01)
(Continued)

(52) U.S. Cl.
CPC ..... *B65D 81/2061* (2013.01); *B65D 83/0055* (2013.01); *B67D 1/0462* (2013.01); *B67D 1/0801* (2013.01)

(58) Field of Classification Search
CPC ..... B65D 81/2061; B65D 83/0055; B65D 31/14; B65D 85/72; B65D 77/04; B67D 1/0462; B67D 1/0801
See application file for complete search history.

(56) References Cited

U.S. PATENT DOCUMENTS 2,687,158 A * 8/1954 Owen ..... B65D 75/5877 206/521
3,265,254 A * 8/1966 Carter ..... B67D 1/0462 222/386.5

(Continued)

FOREIGN PATENT DOCUMENTS

GB 1 233 701 5/1971
GB 2113180 A * 8/1983 ..... B65D 1/0215

(Continued)

OTHER PUBLICATIONS

International Search Report (PCT/ISA/210) issued in PCT/EP2019/069432 dated Nov. 4, 2019.

*Primary Examiner* — Donnell A Long
(74) *Attorney, Agent, or Firm* — Birch, Stewart, Kolasch & Birch, LLP

(57) ABSTRACT

A liquid container includes a first storage level for the liquid, and a second level of pressurization for a gas. The first and second levels can be stored flat when empty. The first level and/or the second level has a first and/or a second non-return connection part, including: a first fitting body, a first base, a non-waterproof first stop to limit the movement of the first one, a first waterproof shoulder to limit the movement of the first base and to prevent fluid backflow, and a first connector configured to connect to a third connection part of a fluid injection and/or extraction system.

19 Claims, 11 Drawing Sheets

(51) Int. Cl.

| | |
|---|---|
| ***B65D 83/00*** | (2006.01) |
| ***B65D 77/04*** | (2006.01) |
| ***B67D 1/04*** | (2006.01) |
| ***B67D 1/08*** | (2006.01) |

(56) References Cited

U.S. PATENT DOCUMENTS

| | | | | | |
|---|---|---|---|---|---|
| 3,294,289 | A * | 12/1966 | Bayne | B67D 1/0462 | 222/386.5 |
| 4,256,150 | A * | 3/1981 | Mockesch | B67D 1/0462 | 141/10 |
| 4,796,788 | A * | 1/1989 | Bond | B67D 1/045 | 222/105 |
| 5,145,083 | A * | 9/1992 | Takahashi | B65D 75/5877 | 222/509 |
| 2001/0023572 | A1* | 9/2001 | Savage | B65D 77/06 | 53/449 |
| 2005/0268985 | A1* | 12/2005 | Litto | B67D 1/0878 | 141/67 |
| 2008/0272146 | A1* | 11/2008 | Kaczmarek | B65D 77/04 | 222/105 |
| 2010/0096040 | A1* | 4/2010 | Litto | B67D 1/0462 | 141/285 |
| 2015/0102058 | A1* | 4/2015 | Lyon | B65D 35/28 | 222/95 |

FOREIGN PATENT DOCUMENTS

| | | | | |
|---|---|---|---|---|
| WO | WO 98/01752 | A1 | 1/1998 | |
| WO | WO-2018113980 | A1 * | 6/2018 | B05B 9/0838 |

* cited by examiner $T \propto (P1-P0).dS$

LIQUID CONTAINER

TECHNICAL FIELD

The present invention relates to the field of liquid packaging, in particular for the storage and transport of liquids in pressure equilibrium with a gas.

In particular, the present invention relates to the packaging of carbonated beverages (such as beer) for transport, storage and distribution in drinking establishments or private homes.

TECHNOLOGICAL BACKGROUND

Carbonated drinks, such as beer, are products that are produced in factories (or breweries in the case of beer) and then packaged in containers, such as kegs. They are then distributed in drinking establishments or private homes through networks adapted to each market.

In the case of beer, for example, it contains dissolved carbon dioxide in equilibrium with carbon dioxide gas under pressure. This pressure balance is necessary to preserve the organoleptic properties of the beer. Containers used for the storage, transport and final distribution of beer must therefore withstand an internal overpressure of between 1 and 4 bar.

Beer is also a product of the fermentation of various organic materials in the aqueous phase. The cleanliness and sanitary condition of the storage container is important so that the beer does not degrade under the action of uncontrolled fermentation induced by bacteria present in the container at the time of filling.

Two types of containers for the transport and distribution of beer can be cited.

The first type comprises the kegs. They have a large capacity (at least 10 liters, usually 30 liters). In addition, they are mainly intended for the pub market or for public or private events (parties, fairs, etc.). The beer is extracted from the kegs at the moment of consumption by means of the pressure in the keg, which must be kept constant as the keg is emptied.

The second type includes bottles and mini-kegs. They are of limited capacity. They are generally intended for the individual consumers and drinking establishments.

Beer is a product on which the price of the container and also the price of its transport or storage (full or empty) has a strong impact on the selling price to distributors or consumers. It can represent a share of the order of 10% for distances between place of production and place of consumption on a city scale. Reducing this cost is a real challenge for brewers because this increases their margins. Another reason is that it also makes it possible to make certain customers in remote geographic areas more accessible. By reducing the cost of transportation, it is possible to reach a larger customer base, freeing them from the criterion of remoteness.

Additional issues and constraints exist.

Reducing the ecological footprint related to the storage, transportation and recycling of containers is also a major challenge, especially for the microbrewery market, which is mostly sensitive to this issue.

In addition, kegs for drinking establishments must have at least three characteristics.

A first characteristic is that they must be suitable for filling in breweries. The kegs must therefore be compatible with the brewers' filling equipment.

A second characteristic is that the kegs must be suitable for transport, storage and sometimes for the second fermentation of the beer. This is therefore a double characteristic, both logistical (including the return or recycling of empty kegs) and sanitary.

A third characteristic is that the kegs must be suitable for serving beer. They must therefore be compatible with the distribution lines in the drinking establishments (so-called "python" lines). They must also be compatible with a fast and uninterrupted service during opening hours (10 kegs of the same beer can be dispensed during the same evening).

To meet these constraints, several solutions exist.

A first solution (the majority on the market) uses reusable metal kegs. These kegs are purchased by brewers who recollect them once emptied in the drinking establishments and recondition them for each use. This first solution suffers from many disadvantages.

First of all, this type of keg has a very high cost, whereas they have to be purchased in large numbers by brewers. It is therefore a very important investment and capital immobilization for them. This cost can limit brewers in their sales during peak consumption periods (such as vacations or sporting events). Choosing to oversize the keg park to cope with consumption peaks is not necessarily an economically relevant solution. In addition, these high-cost kegs can be lost or stolen during return transport to the brewers.

Beyond the high intrinsic cost of metal kegs, they require high maintenance costs. Indeed, metal kegs must be cleaned with each use, which requires the use of washers that are also an investment for breweries and potentially irritating and polluting products. In addition, the cleaning work is very hard on the workers who perform it.

In terms of logistics, these kegs are heavy, more than ten kilograms per unit, which makes them difficult to handle when full (around 45 kilograms). This also makes them very expensive to transport because an inert and unsold mass has to be transported to and from the site.

In terms of use, metal kegs require the use of carbon dioxide for dispensing in drinking establishments. The carbon dioxide is injected into the keg to balance the pressure required to preserve the beer and to provide the necessary force for circulation in the dispensing line. The installation that supplies the carbon dioxide (carbon dioxide bottle) is a cost for the beverage outlet and must remain functional throughout the dispensing process (no dispensing possible if the bottle is empty). It should be noted that some drinking establishments use compressed air (from a compressor and therefore at a lower cost and with a very low risk of service interruption) instead of carbon dioxide, with the risk of degrading the beer due to the presence of oxygen and nitrogen under pressure in contact with it.

In terms of structure, metal kegs are complex to manufacture and handle. They are usually equipped with connection heads (of which there are several models) that allow connection to the distribution line and to the pressurization plant. These heads combine the two types of connection (beer outlet and pressurization inlet) in a single object, which leads to relatively complex connection heads (managing the tightness of a liquid flow and a gaseous flow) and relatively complex manipulations when changing the keg (cutting off circuits, possible purges, reopening of circuits) which can take up to 10 minutes per change and require learning. Finally, these kegs must be used in a vertical position and once empty, carbon dioxide can enter the distribution line and cause incidents (foaming). It follows that such kegs cannot simply be installed in Series-Parallel (to increase the quantity of beer delivered in a service) because once empty, the carbon dioxide emitted disturbs the distribution too much.

A second solution uses disposable (single-use) plastic kegs (usually PET) into which carbon dioxide is injected on contact with the beer (this type of keg is distributed under the trade names Dolium® or Petainer® for example). These kegs meet most of the disadvantages of metal kegs but still suffer from a number of problems.

In particular, although they eliminate the problem of returning to the brewers and cleaning through the use of PET and their single-use, these kegs remain complex in their structure and use in drinking establishments. In reality, only the material of the keg changes, but not the structure. The disadvantages of metal kegs in this respect therefore remain.

Moreover, although PET is theoretically recyclable, in practice this type of keg is only recyclable to a very limited extent. The ecological footprint is therefore very negative for this type of keg.

A third solution uses disposable plastic pouch kegs (single use of the set). The beer is enclosed in a pouch kept under pressure by a gas injected between the keg and the pouch (this type of keg is distributed under the trade name Keykeg® for example). Unlike the second solution, the injected gas does not come into contact with the beer. The material used is also PET.

Thus, kegs under this third solution actually suffer from the same disadvantages as kegs under the second solution (complexity and real negative ecological footprint).

A fourth solution uses reusable plastic kegs wherein single-use pouches are inserted and wherein the beer is stored (this type of system is distributed under the trade name Ecofass® for example).

This solution actually reintroduces one of the major drawbacks of metal kegs because the reusable plastic keg reintroduces the problem of return logistics. This reusable keg at a very high cost and induces an important logistic cost. In addition, it still suffers from the same other problems as those noted for the other solutions.

Thus, despite the various solutions available for containing soft drinks such as beer, for example, there is still a need for a container that is optimal in terms of cost, logistics, structure and ecological footprint.

The above-mentioned problems are not only a problem for beer or soft drinks of this type. The same problems can also be encountered with other types of drinks such as wine, for example. In addition, this type of problem can also be encountered in other areas, such as liquefied gas, for example. Thus the need identified below does not only concern beer and other types of carbonated drinks, but also other types of liquefied liquids or gases.

The present invention lies within this context.

SUMMARY OF THE INVENTION

According to a first aspect, the invention relates to a container for liquid comprising:

- a first storage level configured to store the liquid,
- a second level of pressurization configured to receive a gas in order to keep the first level under pressure,
- wherein the first and second levels can be stored flat when empty of gasified liquid and gas,
- wherein the first level has a first pouch with a first part of a non-return coupling,
- wherein the second level has a second pouch with a second non-return connection part,
- wherein the first connection part and/or the second connection part comprises:
- a first fitting body,
- a first base configured to move inside the first connector body,
- a non-watertight first stop included inside the first connector body to limit the movement of the first base in a first direction of the first connector body, and
- a first waterproof shoulder included within the first connector body to limit movement of the first base in a second direction of the first connector body and to prevent back flow of fluid from the first pouch and/or the second pouch, and
- first means of connection to a third connection part of a fluid injection and/or extraction system.

For example, the first and second levels may be stored flat when they are empty of gasified liquid and gas with a thickness of less than 5 cm.

Depending on the design, the first connection part and/or the second connection part further comprises a first rod extending from said first base in the second direction, said first rod being configured to prevent sealing contact between said first base and said first shoulder once the first connection part is connected to said third connection part.

For example, said first and second non-return connection parts are integrated.

According to embodiments, the container also includes an envelope configured to maintain said first and second levels in a maximum volume, said envelope being configured to be stored flat.

For example, said envelope is configured to be stored flat with a thickness of less than 5 cm.

For example, the casing has an opening for the passage of the first part of the non-return connection part and/or the second part of the non-return connection part.

According to embodiments, said envelope is detachable from said first and second levels.

For example, said envelope has an opening for the introduction and extraction of said first and second levels.

For example again, this opening is reversible in opening and closing.

According to embodiments, the first storage level is contained in the second storage level.

For example, the first and second levels are juxtaposed. For example, they have a common wall.

Again, for example, the container is configured to hold a gasified liquid and wherein the first level is configured to store the gasified liquid in such a way as to retain the gaseous properties of said gasified liquid.

According to a second aspect, the invention relates to a system of distribution of gasified liquid comprising:

- a container according to the first aspect,
- a fluid injection and/or extraction device, and
- a kit for connecting said container to the injection and/or extraction device comprising said third connection part,
- wherein this third connection part comprises:
- a second connector body,
- second means of connection to said second connection part,
- a second base configured to move inside the second connector body,
- a second non-sealing stop inside the second fitting body to limit the movement of the second base in a first direction of the fitting body, and
- a second waterproof shoulder included within the second connector body to limit the movement of the second base in a second direction of the second connector body and to prevent the return of fluid from the first pouch and/or the second pouch, and a second rod extending from said second base in the second direction, said second rod being configured to prevent sealing contact between said second base and said first shoulder once the third connection part is connected to said first or second connection part.

For example, said first and second rods are axially aligned when the first and second connecting means are connected and wherein the lengths of the rods are chosen such that when the first base is in contact with the first stop, the second base does not contact the second sealing shoulder, and when the second base is in contact with the second stop, the first base does not contact the first sealing shoulder.

For example, the connection kit also includes:

a fourth non-return connection part, a fifth non-return connection part, and means for circulating fluid from the fourth connection part to said third and fifth connection parts, wherein said fourth connection part includes means for adjusting a differential pressure to allow fluid flow.

According to a third aspect, the invention relates to a container for liquid comprising:

a first storage level configured to store the liquid, a second level of pressurization configured to receive a gas in order to keep the first level under pressure, wherein the first and second levels can be stored flat with a thickness of less than 5 cm when empty of gasified liquid and gas, the container further comprises, an envelope configured to maintain said first and second levels in a maximum volume, said envelope being configured to be stored flat with a thickness of less than 5 cm.

For example, said envelope is detachable from said first and second levels.

For example, the envelope has an opening for the introduction and extraction of the first and second levels.

According to embodiments, this opening is reversible in opening and closing.

The first storage level may be contained in the second storage level.

Alternatively, the first and second levels may be juxtaposed.

Alternatively, the first and second levels can have a common wall.

According to embodiments, the first level includes a first pouch with a first part of a non-return connection.

For example, the second level has a second pouch with a second part of a non-return connection part.

For example, the first and second non-return connection parts are integrated.

Depending on the design, the casing has an opening for the passage of the first part of the non-return connection part and/or the second part of the non-return connection part.

It is possible to provide that the first and/or second connection part has:

a first fitting body, a first base configured to move inside the first connector body, a non-watertight first stop included inside the first connector body to limit the movement of the first base in a first direction of the first connector body, and a first waterproof shoulder included within the first connector body to limit movement of the first base in a second direction of the first connector body and to prevent back flow of fluid from the first pouch and/or the second pouch, and first means of connection to a third connection part of a fluid injection and/or extraction system.

Depending on the design, the first connection part and/or the second connection part further comprises a first rod extending from said first base in the second direction, said first rod being configured to prevent sealing contact between said first base and said first shoulder once said first connection part is connected to said third connection part.

According to examples, the container is configured to hold a gasified liquid and the first level is configured to store the gasified liquid in such a way as to maintain the gaseous properties of said gasified liquid.

According to a fourth aspect, the invention relates to a system for the distribution of gasified liquid comprising:

a container according to the third aspect, a fluid injection and/or extraction device, and a kit for connecting said container to the injection and/or extraction device comprising said third connection part, wherein this third connection part comprises:

a second connector body, second means of connection to said second connection part, a second base configured to move inside the second connector body, a second non-sealing stop inside the second fitting body to limit the movement of the second base in a first direction of the fitting body, and a second waterproof shoulder included within the second connector body to limit the movement of the second base in a second direction of the second connector body and to prevent the return of fluid from the first pouch and/or the second pouch, and a second rod extending from said second base in the second direction, said second rod being configured to prevent sealing contact between said second base and said first shoulder once said third connection part is connected to said first or second connection part.

For example, said first and second rods are axially aligned when the first and second connecting means are connected and wherein the lengths of the rods are chosen such that when the first base is in contact with the first stop, the second base does not contact the second sealing shoulder, and when the second base is in contact with the second stop, the first base does not contact the first sealing shoulder.

According to embodiments, this connection kit also includes:

a fourth non-return connection part, a fifth non-return connection part, and means for circulating fluid from the fourth connection part to said third and fifth connection parts, wherein said fourth connection part includes means for adjusting a differential pressure to allow fluid flow.

BRIEF DESCRIPTION OF THE FIGURES

Other characteristics and advantages of the invention will appear when reading the following detailed description, as an example, and the annexed figures among them.

DETAILED DESCRIPTION OF THE INVENTION

Figure 1:
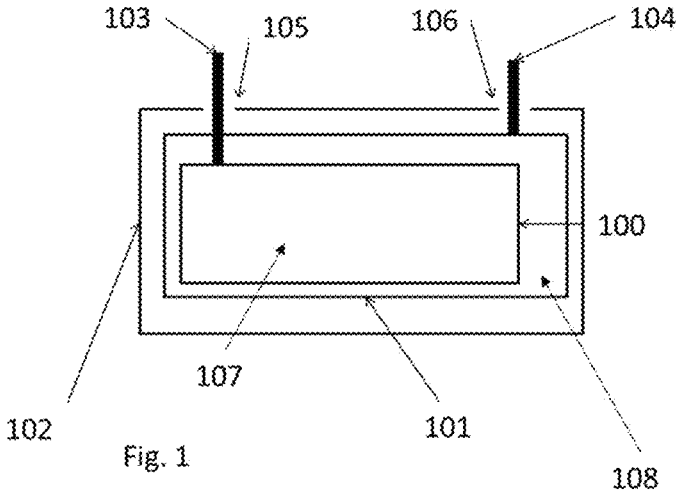
FIG. 1 schematically illustrates a three-level embodiment.

The embodiments of the invention which are described in the following offer a large number of advantages among which:

- the limitation of the brewers investment in kegs, which allows him not to limit his sales capacity during peaks in consumption, for example in summer,
- the elimination of risks related to the loss of kegs during possible returns,
- elimination of keg cleaning operations,
- limitation of the mass to be transported or handled both full and empty (ergonomics for the employees is improved),
- the limitation of the logistic volume of storage for empty kegs,
- limiting the cost and ecological footprint of transportation,
- limiting the ecological footprint of the waste generated by the use of the container,
- the possibility of using a simple, reliable and inexpensive pressure source,
- the possibility of using a simple installation in drinking establishments that minimizes the downtime of a distribution line,
- the possibility of long-term storage of beer during storage but also once the container has been opened,
- optimization of the cost of storage and transport per liter of beer sold.

The structure of the container according to the embodiments of the invention comprises several levels.

In a first level ("level 1"), the container according to the invention comprises a pouch or a set of pouches whose function is to store a gasified liquid, i.e. a liquid in which bubbles of inert gas (CO2 type) are trapped.

This pouch or set of pouches is suitable for the conservation of the stored liquid, in particular its food qualities in the case of beverages. In particular, the pouch or set of pouches can provide impermeability to oxidizing agents and prevent the pollution of the liquid by potentially harmful residues (for example, of the endocrine disruptor type) from the pouch or set of pouches itself.

It is not necessary for this pouch or set of pouches to have special characteristics such as high mechanical resistance or a particular color (which allows the filtering of certain light radiations that are detrimental to the quality of the product). This stress relief simplifies the choice of material for this pouch.

The only mechanical resistance expected from this Level 1 is that of resisting the pressure exerted by the gas contained in Level 2 described below and the mechanical effects linked to tossing in the transport phases (a phenomenon known as "Flex-Cracking" in Anglo-Saxon terminology).

The materials that can be used are for example films made of:

- EVOH (Ethylene vinyl alcohol),
- Soft PVC (Polyvinyl Chloride),
- MET-PET (Metallized Polyester),
- LLDPE (acronym of "Linear low-density polyethylene" in Anglo-Saxon terminology) or MDPE (acronym of "Medium-density polyethylene" in Anglo-Saxon terminology).

In a second level ("level 2") the container has a pouch or set of pouches whose function is to contain a pressurized gas that keeps level 1 under pressure so that the stored liquid does not degas and at the same time provides the energy necessary for the distribution of the liquid.

This second level can be contained within the first level. Alternatively, the two levels are juxtaposed while allowing level 2 to maintain level 1 under pressure. For example, a common wall can be provided for both levels.

In a first alternative, this level 2 pouch or pouch assembly has sufficient opacity, mechanical strength and inextensibility characteristics. Thus, level 2 has a maximum volume that it cannot exceed. Level 2 is then designed to have these characteristics in addition to being impermeable to the pressurizing gas.

In a second alternative, these characteristics of opacity, mechanical strength and inextensibility are not imposed at this level 2. They are then transferred to a third pouch level ("level 3").

This level 3 of the container includes an envelope or set of envelopes to ensure the characteristics missing at level 2 (inextensibility, mechanical resistance and/or opacity).

According to some embodiments, Level 3 can be designed in a way that is detachable from Levels 1 and 2, i.e. it is possible to use Level 3 of a container with other Level 1 and 2 sets. This allows the level 3 to be reused. Level 3 can be detached from levels 1 and 2 by partial or total dismantling of the envelope or by means of a media integrated into the envelope which allows it to be opened and closed without dismantling operations.

This level 3 envelope or set of envelopes can be made with a mesh material whose mesh size (empty orifice) is small enough to allow the level 2 pouch or set of pouches to rest on it without breaking. This feature allows the use of materials such as meshes, woven fabrics with more or less tight weft and warp, or flexible "mesh size" type assemblies (made of metal or any other suitable material) for this level 3.

These different levels of pouches make it possible to:

- ensure that the total volume of the liquid and gas contained inside does not exceed a certain limit (inextensibility),
- to be able, if necessary, to protect the preserved product from certain luminous radiations (opacity),
- to preserve the product to be preserved from any pollution and to separate the pressurized gas from the product to be preserved.

Advantageously, Level 1 has a "draft interface" allowing it to connect to a liquid filling or distribution line without coming into contact with the pressurized gas.

Even more advantageously, Level 2 is equipped with a "pressure interface" allowing it to connect to a pressurization line, preserving the stored liquid from contact with the pressurizing gas.

For example, these 2 interfaces can be combined into one or separated according to the desired compatibility with existing connection systems.

Level 3 may include one or more passages allowing the passage of the "pressure interface" and the "draft interface" or the single interface while allowing their connection to external devices in a simple way (filling, draft, pressurization) and preserving, if necessary, the possibility of dissociating levels 1 and 2 from level 3.

FIG. 1 schematically illustrates a three-level embodiment.

Level 1 has a pouch 100 defining volume 107 containing the liquid to be stored and dispensed. Level 2 includes a pouch 101 which contains pouch 100 (alternatively, instead of being included in pouch 100, pouch 101 can simply be juxtaposed to it or have a common wall). Volume 108 between pouch 100 and pouch 101 contains the gas that keeps the liquid in pouch 100 under pressure and allows the liquid to be drawn off (in the case of two juxtaposed pouches, the gas under pressure is contained in the volume of pouch 101). Level 3 is optional and includes an envelope 102 which limits the total volume of the container.

Pouch 100 is equipped with a draw-off interface 103 equipped with a standard connector allowing the filling or draw-off of the liquid according to the mode of use (for example an "aquastop" type connector). This interface is tightly connected to pouch 100 and passes tightly through pouch 101 which has a passage for this purpose. The interface 103 also passes through pouch 102, which also contains a passage 105 provided for this purpose, which is not necessarily leakproof.

Pouch 101 is equipped with a pressure interface 104 with a connector allowing the injection or ejection of pressurized gas according to a mode of use (for example a male quick coupling of the ISO 6150B type). This interface is tightly connected to pouch 101. The interface 104 passes through the envelope 102 which also contains a passage 106 provided for this purpose, which is not necessarily tight.

Level 3 can be detachable, and passages 105 and 106 can be used to remove interfaces 103 and 104.

Depending on the embodiment, levels 1 and 2 are weldable plastics. Levels 1 and 2 can then be welded to a through-sleeve at this point. The sleeve then has a border on the inner side allowing the welding of the pouches or set of pouches of levels 1 and 2 and presenting on the outer side a male interface for a quick connector of the type commonly used in watering systems. For example, this may be a "Gardena®" type connector interface.

A method of making an envelope 102 is described with reference to FIGS. 19 and 20.

Figure 19:
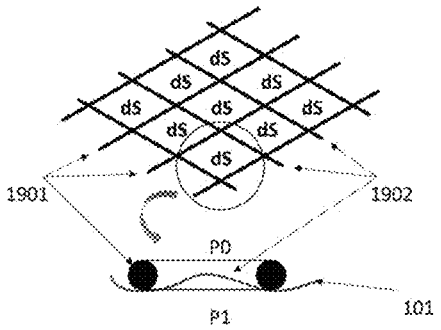
FIG. 19 illustrates an envelope meshed by a weft thread and a warp thread according to embodiments.

FIG. 19 shows an envelope meshed by a 1901 weft yarn and a 1902 warp yarn. This weft leaves free surfaces marked "dS" in FIG. 19. These free areas can be larger or smaller and possibly zero. A weft with this design reduces the stress on the level 2 pouch 101 which is supported by this mesh when it is inserted in the envelope 102 and the container is filled with liquid and/or gas. The stress tensor to which the level 2 pouch 101 is subjected is in fact proportional to the pressure difference P1−P0 between the inside and outside and to the surface dS.

If the surface dS is zero (in the case of a continuous envelope or a very tight mesh fabric) then the stress tensor is zero and the level 2 pouch is subjected to a crushing force and is not subjected to any transverse force. No strength specification is then to be defined for the level 2 pouch 101.

Forgiven mechanical strength characteristics of Level 2 Pouch 101 (coefficients of elasticity, yield strength, etc.), simply choose a mesh envelope whose surface and mesh geometry allow the material of the Level 2 pouch to remain within the elastic range. The calculation of the optimal mesh (size and geometry) must be done by finite element calculation in a pre-dimensioning phase of the system and then confirmed by a test phase.

Figure 20:
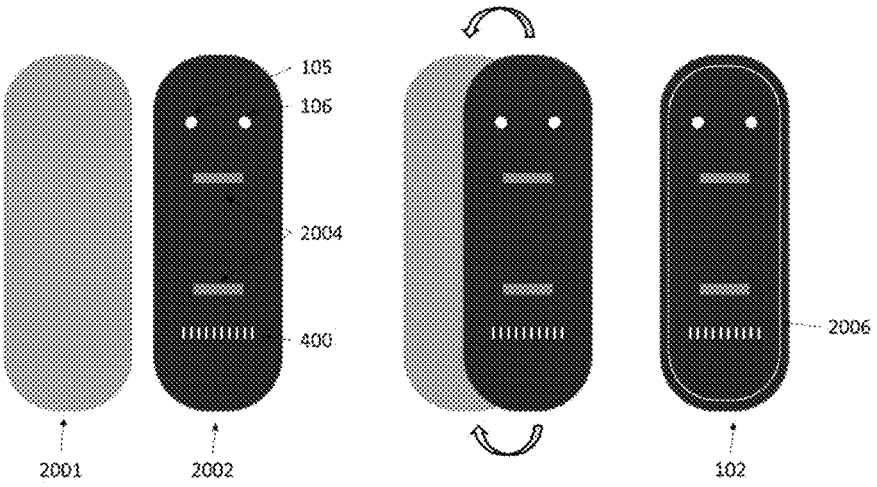
FIG. 20 illustrates an envelope according to different embodiments.

FIG. 20 illustrates how a 102 envelope can be made. A piece of fabric 2001 is cut to serve as the first wall. For example, it is a wall that does not have the through-holes for the pull and pressure interfaces. In this case this wall can be called a rear wall. A second piece of fabric 2002 is cut in the same shape as piece 2001. This second piece can have the through holes for the pull and pressure interfaces 105 and 106. This part can then be described as the front wall. The holes are made in the fabric part and possibly reinforced. Transport handles and fasteners for stacking 2004 are optionally attached to part 2002. For example, these handles are sewn onto part 2002. A quick-opening 400, e.g. a zipper or buttons, can optionally be fitted so that levels 1 and 2 can be changed without dismantling the whole unit (i.e. in the case of a fabric cover without having to cut it open). The two pieces of fabric are then superimposed and sewn with a 2006 stitch whose thread and stitch characteristics allow the expected mechanical characteristics to be respected.

Alternatively, instead of fabric parts, PVC parts can be assembled. In this example, the pieces, instead of being sewn together, can be welded at their edges. Edge welding can be used with other types of materials that are compatible with this technique.

The advantage of these manufacturing methods is that the empty envelope can be delivered flat before filling and after the complete run of the stored product. The logistical advantage is a space saving of a factor of 20 compared to all competing products.

Generally speaking, levels 1, 2 and 3 of the container allow flat storage of the container or each of its components. Such flat storage is made possible, for example, by a flat thickness of each of these levels and/or of the container of 5 cm or less (thickness W1 illustrated in FIG. 5 for example). Such a thickness may for example be 1 cm or less. Alternatively, a thickness of between 1 and 5 cm can be provided, depending on the materials used. Value ranges for this thickness can also be 2 cm or less, 3 cm or less, or 4 cm or less. Other examples can also be between 2 and 3 cm, 3 and 4 cm or 4 and 5 cm. Combinations of these value ranges are also possible. All these value ranges are also possible for levels 1 and 2 and the pouches they contain.

According to embodiments, the dimensions of the container are of the order of 150 cm length, 30 cm width and 1 cm thickness when empty of liquid and gas. This same container when it is completely full of liquid and/or gas can have dimensions of about 140 cm in length. This length is narrower than the empty container because its dimensions in the plane orthogonal to its length have increased due to inflation by the liquid and/or gas. These dimensions in this plane are for example included in a diameter of 20 cm.

Figure 2:
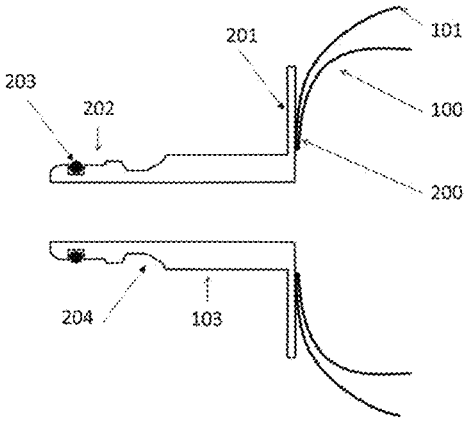
FIG. 2 illustrates connection sleeves according to embodiments.

FIG. 2 illustrates a method of making the sleeve of connection 103 in the case of a pouch 100 included in a pouch 101. For the sake of brevity, the anti-return system is not shown. However, it can be made in a conventional way by the person skilled in the art (e.g. a conventional non-return system or a two-way system that may or may not be integrated into the sleeve).

The sleeve has a base 201, e.g. circular, to which the pouches 100 and 101 are welded, e.g. with a weld 200 of the type used for thermoplastic welding (thermal, ultrasonic or high-frequency welding). The end 202 of the sleeve has fixing and sealing means for connection to a system for the flow of the liquid contained in pouch 100 or a system for filling the bag. The end 202 is at a sufficient distance from the base 201 to allow the sleeve to pass through level 3 and envelope 102 without interfering with the attachment of the sleeve to the flow or filling system.

This end 202 has a sealing ring 203 held in a first circumferential groove. This ring is capable of cooperating with an orifice in the flow system. In addition, it has a second groove 204 that can cooperate with a fastening means of the flow system to keep the sleeve connected.

Figure 3:
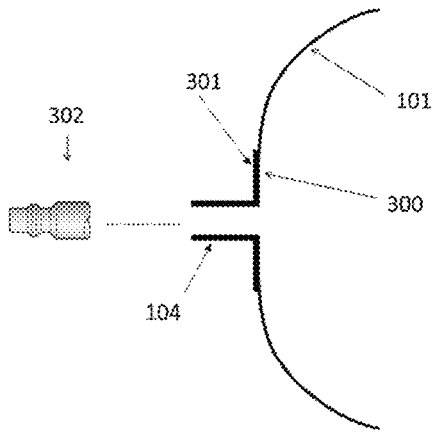
FIG. 3 illustrates connection sleeves according to embodiments.

FIG. 3 shows a method of making the sleeve for connection 104. As for connection 103, for the sake of brevity, the non-return system is not shown. However, it can be made in a conventional way by the person skilled in the trade (e.g. a conventional non-return valve or a two-way valve that may or may not be integrated into the sleeve).

The sleeve has a base 301, for example circular, to which the 101 pouch is welded, for example by a weld 300 of the type used for welding thermoplastics (thermal, ultrasonic or high frequency welding). The end 302 of the sleeve has fastening and sealing means for connection to a gas injection and ejection system. For example, this end is of the ISO 6150B type. The end 302 is located at a sufficient distance from the base 301 to allow the sleeve to pass through level 3 and envelope 102 without interfering with the attachment of the sleeve to the gas injection or ejection system.

The use and operation of containers according to embodiments are described with reference to FIGS. 4 to 10.

Figure 4:
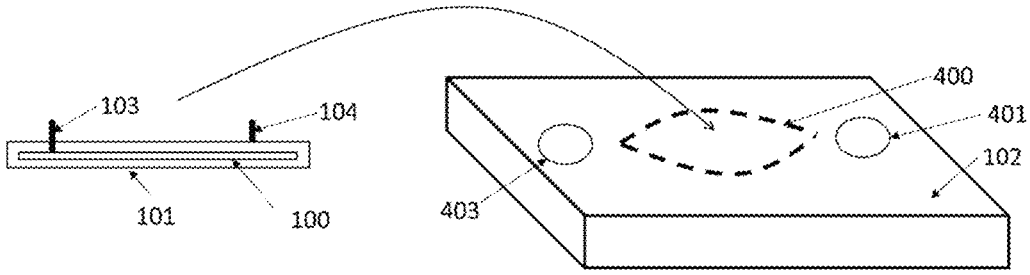
FIG. 4 illustrates the use and operation of containers according to embodiments.

First, as shown in FIG. 4, the level 1 and 2 pouches are inserted into a level 3 envelope. This step can be carried out in the keg manufacturing plant, in a reconditioning site or in the packaging site of the liquid to be dispensed. The envelope 102 can be a new envelope or a reused envelope following a return through a beverage outlet (the return circuit will be described in the following).

In embodiments where the 102 envelope is attached to levels 1 and 2, this step can be omitted.

The envelope thus includes a 400 opening and closing system allowing the introduction of level 1 and 2 pouches. This system of opening and closing can be for example a zipper (of type ZIP), a system of buttons. The closing system can be reversible or irreversible. For example, it is possible to provide a seam that will be undone when there is a need to remove the level 1 and 2 pouches from the envelope. A new seam can then be made when new pouches are inserted.

The envelope also has two openings 403 and 401 to allow the passage of sleeves 103, 104 respectively.

Before filling, the assembly formed by the pouches of levels 1 and 2 as well as the 102 envelope of level 3 are in an ultra compact format. They can be stored flat or even folded or rolled. Their weight is also very low.

Figure 5:
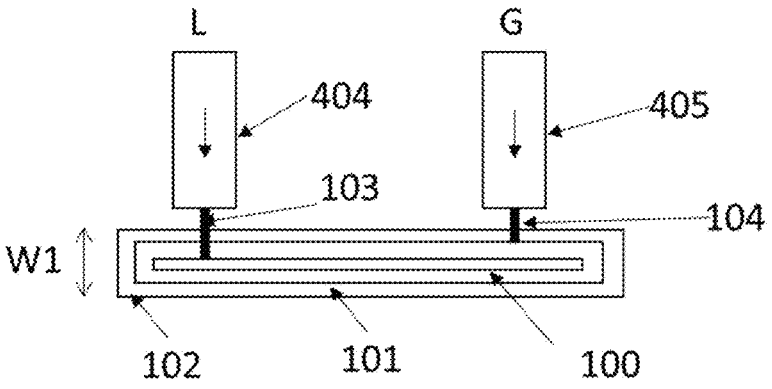
FIG. 5 illustrates the use and operation of containers according to embodiments.

Then, as shown in FIG. 5, the container will be connected to liquid filling and gas injection systems. Sleeve 103 is connected to a filling system 404 which introduces (as indicated by the arrow) a liquid L (e.g. beer) into level 1 pouch 100. Sleeve 104 is connected to an injection system 405 which introduces a Gas G (e.g. CO2) into level 2 pouch 101.

Figure 6:
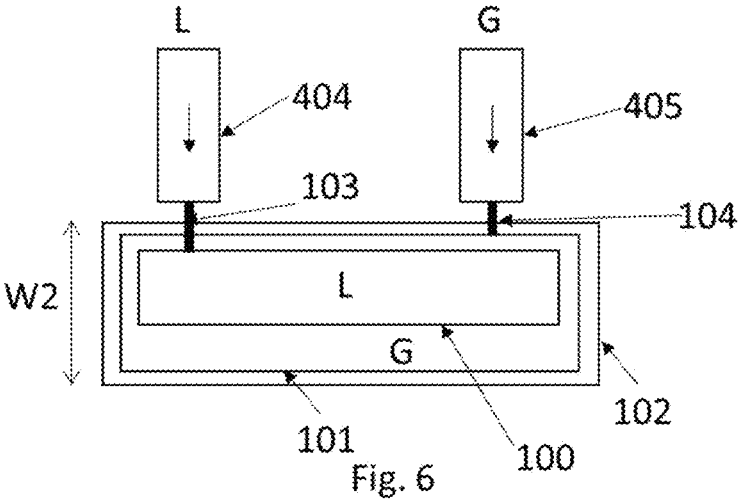
FIG. 6 illustrates the use and operation of containers according to embodiments.

The filled container is shown in FIG. 6. It is the level 3 envelope 102 that sets the maximum external volume of the container. The amount of gas introduced into pouch 102 depends on this maximum volume and the amount of liquid introduced into pouch 100. The objective is to preserve the qualities, for example food grade, of the liquid. In particular, the objective is to preserve the gas itself contained in the liquid.

As can be seen in FIG. 6, pouch 100 which is almost flat in FIG. 5 (thickness W1) has now increased in volume. It now has a thickness W2 greater than W1. The same is true for pouch 101. These pouches are now under pressure and are held by pouch 102.

The container thus packaged is now ready for transport to drinking establishments or private individuals. Transport is facilitated by the fact that the weight transported will almost exclusively consist of the liquid contained in pouch 100, the weight of pouches 100, 101, Gas G and envelope 102 are negligible.

Figure 7:
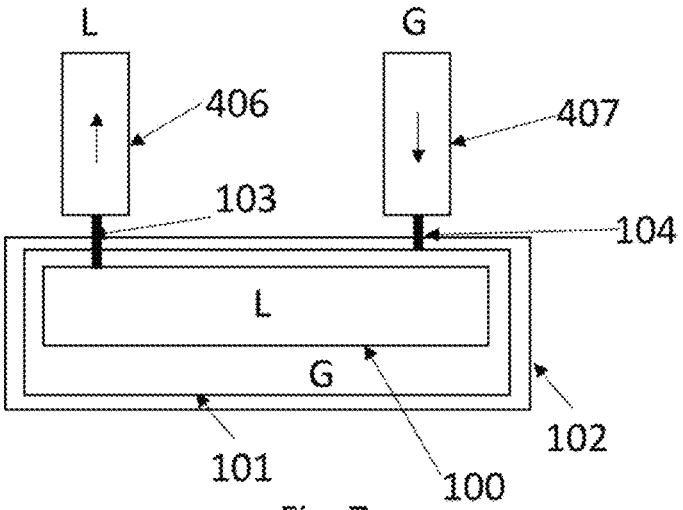
FIG. 7 illustrates the use and operation of containers according to embodiments.

Once received by the beverage outlet or individual, the container is connected to a liquid dispensing system as shown in FIG. 7.

Sleeve 103 is connected to a liquid extraction system 406 which extracts (as indicated by the arrow) the liquid L from pouch 100. The sleeve 104 is connected to a gas injector 407 which (as indicated by the arrow) injects a gas G into pouch 101 to compensate for the decrease in volume of pouch 100 due to the extraction of liquid, in order to maintain a good gas pressure in the liquid.

Figure 8:
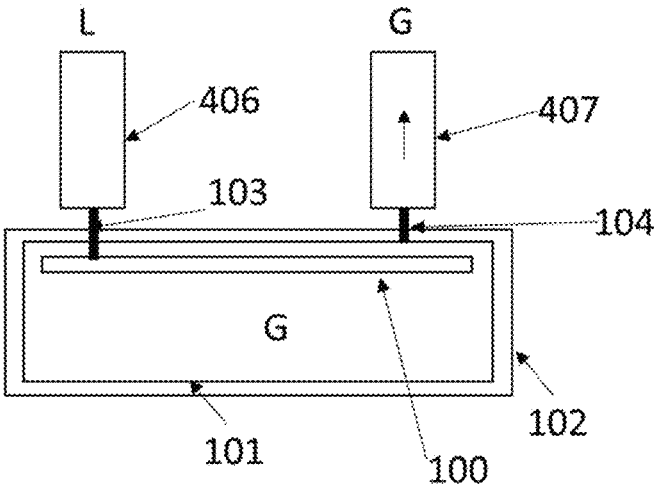
FIG. 8 illustrates the use and operation of containers according to embodiments.

Once the liquid L has been extracted from the pouch, as shown in FIG. 8, pouch 100 is flattened again. The volume left empty by the liquid that has been extracted is occupied by gas G in pouch 101, which therefore has a larger final volume.

At the end of use, the Gas G from pouch 101 is extracted using the 407 gas injector which can be operated reversibly (as indicated by the arrow).

Figure 9:
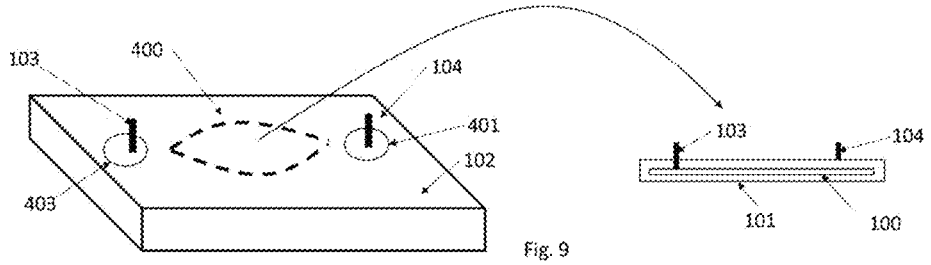
FIG. 9 illustrates the use and operation of containers according to embodiments.

As shown in FIG. 9, once the Gas G in pouch 101 has been emptied, the entire set of level 1 and 2 pouches regains a completely flattened shape and can be removed from the level 3 envelope through the 400 opening.

Figure 10:
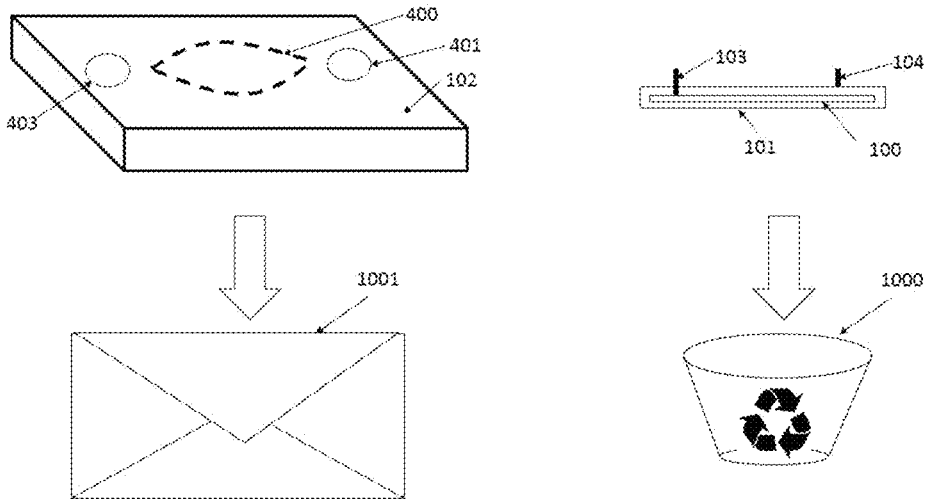
FIG. 10 illustrates the use and operation of containers according to embodiments.

Then, as shown in FIG. 10, pouches 100 and 101 can be scrapped 1000, preferably for recycling.

Envelope 102 can be returned to a reconditioning site for reuse. For this purpose, envelope 102 can be flattened, folded or rolled, so that it can be inserted in a fold that is compatible with postal service standards. Preferably, it can be a rectangular envelope type fold. Of course, the 102 envelope can be sent back to the factory by other logistic means than the Post Office. Nevertheless, since the envelope can be flattened, this logistics is simplified and its cost reduced (reduced volume and weight).

As an incentive for the drinking establishments to return the envelope 102 for reuse, a postage-paid envelope can be delivered with the container. Alternatively, a fee or collection system can be provided for establishments that accept the return of envelope 102.

The envelope 102 is made of recyclable and low-cost materials. In the event that the drinking establishment or individual does not return the envelope 102, this does not penalize the cost of dispensing the liquid.

Depending on the design, two-way waterproof quick couplings can be used for sleeve 103 and/or sleeve 104.

This type of coupling allows the connection and disconnection of interfaces on the fly without pressurized fluid or gas flowing either from the filled container (from which the liquid is extracted) or from the filling source (both of which are under pressure). The use of this type of connection significantly simplifies container changeover operations in the beverage outlet and thus saves time. This quick-release coupling with two-way sealing is described in FIGS. 11 to 13.

Figure 11:
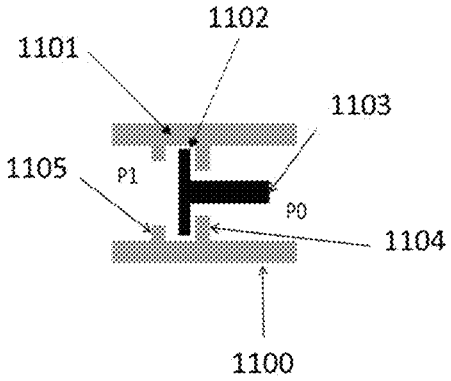
FIG. 11 shows quick-release connections with two-way sealing.

The connection consists of a first part 1100 described with reference to FIG. 11. This part 1100 comprises a body 1101 in which a movable part can move. This movable part has a base 1102 from which a rod 1103 extends. The base 1102 is movable between a mechanical stop 1105 and a waterproof shoulder 1104 present on the inner surface of the body 1101. Sealing is the result of both the surface condition of the shoulder 1104 and the surface condition and material of the base 1102 (typically rubber in the form of an O-ring). In body 1101, the pressure exerted on the moving part on the side of the rod 1103 is noted P0. The pressure exerted on the side of the base 1102 opposite to the rod 1103 is P1. When the pressure P1 is higher than the pressure P0, the base 1102 is pressed against the waterproof shoulder 1104. Conversely, when the pressure P0 is higher than the pressure P1, the base 1102 is pressed against the stop 1105. Thus, this part of the fitting is used to close the liquid or gas circulation when pressure P1 is higher than pressure P2 and to allow the circulation of fluid in other cases. Indeed, the mechanical stop 1105 blocks the movement of the base 1102 but does not seal this part of the coupling.

Figure 12:
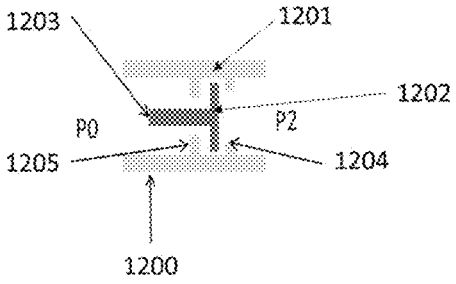
FIG. 12 shows quick-release connections with two-way sealing.

On the 1103 rod side, the 1100 body has means of attachment to a second part of the 1200 fitting described in reference to FIG. 12. For example, these fastening means are a female thread, into which a corresponding male thread of part 1200 can be screwed. This female thread is made on the inner surface of the body 1101, on the side of the shank 1103.

The second part 1200 of the fitting has a body 1201 in which a movable part can move. This mobile part has a base 1202 from which a rod 1203 extends. The base 1202 is movable between a mechanical stop 1204 and a waterproof shoulder 1205 present on the inner surface of the body 1201. Sealing is a result of both the surface condition of the shoulder 1205 and the surface condition and material of the base 1202 (typically rubber in the form of an O-ring). In the 1201 body, the pressure exerted on the moving part, on the side of the 1203 rod, is noted P0. The pressure exerted on the side of the base 1202 opposite to the rod 1203 is noted P2. When the pressure P2 is higher than the pressure P0, the base 1202 is pressed against the waterproof shoulder 1205. Conversely, when pressure P0 is higher than pressure P2, base 1202 is pressed against stop 1204. Thus, this part of the fitting allows to close the liquid or gas circulation when the pressure P2 is higher than the pressure P2 and to allow fluid circulation in other cases. Indeed, the mechanical stop 1203 blocks the movement of the base 1202 but does not seal this part of the fitting.

For the fixing of parts 1100 and 1200 the above mentioned male thread is made on the external surface of the body 1201, on the side of the shank 1203.

Figure 13:
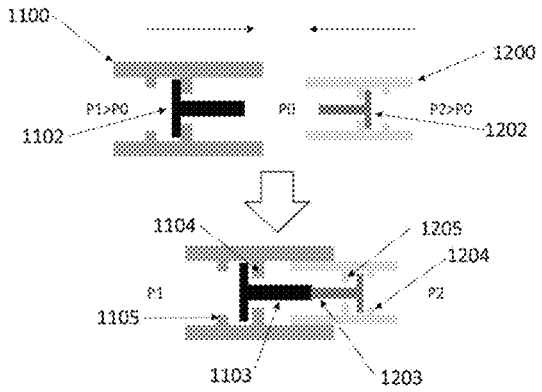
FIG. 13 shows quick-release connections with two-way sealing.

As shown in FIG. 13, parts 1100 and 1200 can be attached to each other.

Parts 1100 and 1200 are attached to each other by their respective sides showing the rods 1103 and 1104. In the example of the thread, the thread of part 1200 screws into the thread of part 1100. Of course, other types of fastening means can be considered (e.g. a clip system or other).

Before they are attached to each other, the pressure P1 on the base 1102 (on the side opposite to rod 1103) is higher than the external pressure P0. This part of the fitting is therefore closed to the flow of fluid or gas. In addition, the pressure P2 on the base 1202 (on the side opposite to rod 1203) is higher than the external pressure P0. This part of the fitting is therefore also closed to the flow of fluid or gas.

When parts 1100 and 1200 are attached to each other, rods 1103 and 1203 are in contact. Their lengths are chosen so that when the base 1202 is in contact with the stop 1204, the base 1102 is not in contact with the waterproof shoulder 1104. They are also chosen so that when base 1102 contacts stop 1105, base 1202 is not in contact with waterproof shoulder 1205.

In this way, parts 1100 and 1200 of the coupling are always through and allow the circulation of liquid and/or gas. Depending on the pressure difference between P1 and P2, the bases 1102 and 1202 are in contact with the stops 1104 and 1205, but due to the choice of the lengths of the rods 1103 and 1203, they are never in contact with the waterproof shoulders 1104, 1205.

Figure 14:
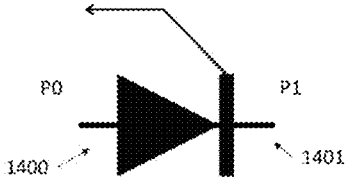
FIG. 14 is a symbol showing the described connection parts without an integrated pressure reducer.

Embodiments in which several containers according to the invention are arranged in series or in parallel to dispense the beverage are now described. In order to simplify the figures, the connection parts 1100 or 1200 are represented by the symbol in FIG. 14. The left side of the figure is the side to which the symmetrical connector is connected and the right side is the side connected to the container or fluid source.

According to this symbol, when the pressure P0 upstream 1400 is higher than the pressure P1 downstream 1401 or when the fitting is connected to its counterpart, the part of the fitting is through and allows the liquid or gas to flow (this corresponds to the case where the base of the rod is pressed against the mechanical stop 1105 or 1204). Conversely, when the pressure P1 is higher downstream 1401 than the pressure P0 upstream 1400 and the fitting is not connected to its counterpart, the fitting part is blocked and prevents the liquid or gas from flowing (this corresponds to the case where the base of the rod is pressed against the waterproof shoulder).

The operating table for such a coupling part is then as follows:

TABLE 1

| Pressure | Not connected or connected to a standard fitting | Connected to another two-way sealing fitting |
|---|---|---|
| P0 > P1 | Switching from P0 to P1 | Two-way passageway |
| P0 < P1 | Blocked | |

Figure 15:
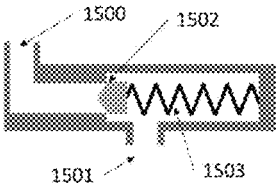
FIG. 15 shows a pressure reducer.
Figure 21:
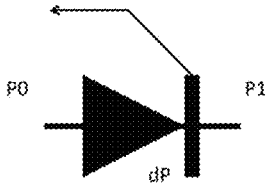
FIG. 21 is a symbol showing the described connection parts with integrated pressure reducer.

In order to enable the switching or blocking state of the connection part to be adjusted, a pressure reducer according to FIG. 15 can be added downstream of such a connection. The downstream part of connection 1401 is connected to the inlet of reducer 1500 and the outlet of the new device is now the outlet of reducer 1501. The pressure differential dP can be adjusted or calibrated by means of spring 1503 which presses the valve 1502. The symbol for this device is shown in FIG. 21. The pressure differential is denoted dP.

The operating table for such a coupling part is then as follows:

TABLE 2

| Pressure | Not connected or connected to a standard fitting | Connected to another two-way sealing fitting |
|---|---|---|
| P0 > P1 + dP | Switching from P0 to P1 | Two-way passageway |
| P0 < P1 + dP | Blocked | |

Figure 16:
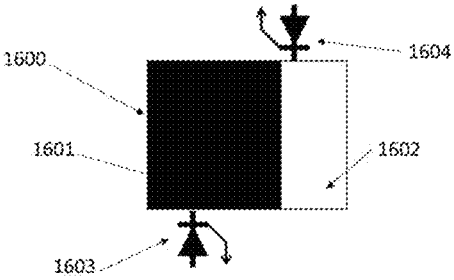
FIG. 16 illustrates a container according to embodiments.

FIG. 16 shows a container 1600 in embodiments with a pouch 1601 (Level 1) to contain a gasified liquid L and a pouch 1602 (Level 2) to contain a gas G and to exert pressure on the pouch 1601. The pouch 1601 is provided with a connection part 1603 which allows to introduce the gasified liquid and to retain it under pressure (for example a connection part according to FIG. 11 and schematized according to FIG. 14). Pouch 1602 is equipped with a connection part 1604 which allows the gas to be introduced and retained under pressure (e.g. a connection part as shown in FIG. 11 and shown in FIG. 14).

As shown in FIG. 16, the container is filled and not connected to a flow system. It is completely waterproof because the pressure exerted by the gasified liquid in pouch 1601 and the gas in pouch 1602 keeps the connection parts 1603 and 1604 closed to the circulation of fluid and gas.

Figure 17:
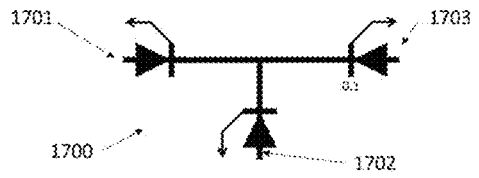
FIG. 17 illustrates a connection kit for connecting a container to a liquid flow (or filling) system.

FIG. 17 shows a 1700 connection kit for connecting a container as shown in FIG. 16 to a liquid flow (or filling) system.

The kit consists of three connection parts 1701, 1702 and 1703 connected in star configuration, with the liquid or gas outlet in common. In a design according to FIG. 17, for example, the connection parts are star-connected on the side opposite the rod.

Connection parts 1701 and 1702 are configured to have a differential pressure dP=0 and connection part 1703 is configured to have a non-zero differential pressure, e.g. 0.1 bar. In this way, the kit can be operated as a pressure reducer. In particular, the kit can be used to put several containers in series according to the invention and allow them to be emptied successively.

Figure 18:
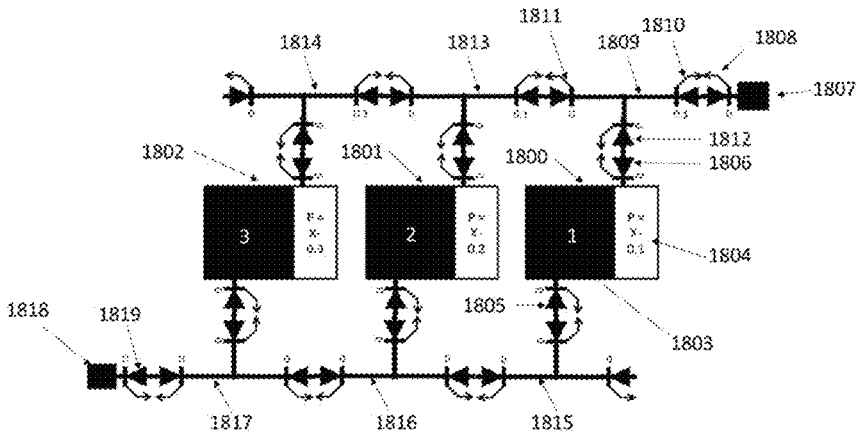
FIG. 18 illustrates a so-called serial-parallel arrangement of three containers.

FIG. 18 shows a so-called series-parallel assembly of three containers 1800, 1801, 1802 according to embodiments. Three containers are illustrated, but the assembly can work for any other number of containers. Container 1800 has a pouch 1803 to contain a gasified liquid and a pouch 1804 to contain a gas. In addition to these level 1 and level 2 pouches, the container can include a level 3 envelope (not shown). Pouch 1803 is connected to a fitting part 1805 for liquid flow. Pouch 1804 is connected to a fitting part 1806 for gas injection.

The other containers have a similar structure and are not detailed for the sake of brevity.

The system is supplied with gas from a pressure source 1807 via a connection part 1808. This connection part is connected to a connection kit 1809 (with three connection parts 1810, 1811, 1812) as described in FIG. 17. Once connected, the two connection parts 1808 and 1810 allow the gas to flow from the source 1807 to pouch 1804 of container 1800. They also allow the gas to flow from the source 1807 to two other connection kits 1813 and 1814 respectively connected to containers 1801 and 1802. These connection kits have the same structure as the 1808 kit and are not detailed for the sake of brevity.

The different connection kits are configured to have non-zero dP differential pressures. In this example, this is valid for each kit dP=0.1 bar. For this purpose, each gas inlet connection part is configured to have a differential pressure dP=0.1 bar. In this way, the connection kits function as pressure reducers. The gas pressure in the pouches of the containers thus decreases with distance from the gas source. Thus, the gas pressure in the level 2 pouch of container 1800 is decreased by 0.1 bar, then that of container 1801 is decreased by 0.2 bar and that of container 1802 is decreased by 0.3 bar.

Thus, the container that empties first is container 1800 (higher pressure), then container 1801 (intermediate pressure), then container 1802 (lower pressure).

For the flow of the gasified liquid, each container 1800, 1801, 1802 is connected to a respective connection kit 1815, 1816, 1817, via a connection part connected to the level 1 pouch (e.g. connection part 1805 for the level 1 pouch 1803 of container 1800).

The connection kits 1815, 1816 and 1817 are thus connected in series and the kit at the end of the chain is connected to a line output 1818 (for example a "Python" type output for beer tappers). For circulation of the carbonated liquid and sealing, the connection to the line outlet 1818 is made via a connection part 1819.

In the system described with reference to FIG. 18, the gas pressure inlets are connected in series with pressure reducers inserted between the pressure interfaces. It is thus possible to have single reducer kits—in the example below 0.1 bar—and thus to have strictly decreasing pressures between the containers. These reducers are also valves that prevent backflow if they are disconnected (as described above with reference to FIGS. 11 to 13). The draught outlets are connected in parallel so that the containers are emptied one after the other in the order of decreasing pressure applied by the previous reducers.

The use of non-return valves or possibly two-way sealing systems as described above in the connection kits and on the containers themselves allows all or part of the empty kegs to be changed during distribution without interrupting service.

This system makes it possible to put a large number of containers in parallel series but also to change them on the fly without interrupting service an empty container if necessary.

The present invention has been described and illustrated in the present detailed description with reference to the attached figures. However, the present invention is not limited to the embodiments presented. Other variants, embodiments and combinations of characteristics may be deduced and implemented by the person skilled in the art when reading this description and the attached figures.

In order to satisfy specific needs, a person skilled in the art of the invention may apply modifications or adaptations.

In claims, the term "include" does not exclude other elements or steps. The indefinite "one" does not exclude the plural. The different features presented and/or claimed may be advantageously combined. Their presence in the description or in different dependent claims does not exclude the possibility of combining them. Reference signs cannot be understood as limiting the scope of the invention.

The invention claimed is:

1. A gasified liquid distribution system comprising:

a container, the container comprising:

a first storage level configured to store the liquid;

a second pressurization level configured to receive a gas in order to keep the first level under pressure, wherein the first and second levels can be stored flat when empty of gasified liquid and gas, wherein the first level has a first pouch with a first non-return connection part, wherein the second level has a second pouch with a second non-return connection part, wherein the first connection part and/or the second connection part comprises:

a first connector body;

a first base configured to move inside the first connector body;

a non-waterproof first stop included within the first connector body to limit the movement of the first base in a first direction of the first connector body;

a first waterproof shoulder included within the first connector body to limit movement of the first base in a second direction of the first connector body and to prevent fluid return from the first pouch and/or the second pouch; and a first connector configured to connect to a third connection part of a fluid injection and/or extraction system;

a device for injection and/or extraction of fluid; and a connection kit for connecting said container to the injection and/or extraction device comprising said third connection part, wherein this third connection part comprises:

a second connector body;

a second connector configured to connect to said second connection part;

a second base configured to move inside the second connector body;

a non-waterproof second stop included inside the second connector body to limit the movement of the second base in a first direction of the connector body, a second waterproof shoulder included within the second connector body to limit the movement of the second base in a second direction of the second connector body and to prevent the return of fluid from the first pouch and/or the second pouch, and a second rod extending from said second base in the second direction, said second rod being configured to prevent sealing contact between said second base and said first shoulder once the third connection part is connected to said first or second connection part.

2. The system according to claim 1, wherein said first and second rods are axially aligned when the first and second connecting means are connected and wherein the lengths of the rods are selected such that when the first base is in contact with the first stop, the second base does not contact the second sealing shoulder, and when the second base is in contact with the second stop, the first base does not contact the first sealing shoulder.

3. The system according to claim 1, wherein said connection kit further comprises:

a fourth non-return connection part, a fifth non-return connection part, and means for circulating fluid from the fourth connection part to said third and fifth connection parts, wherein said fourth fitting part has means for adjusting a differential pressure to allow fluid flow.

4. The system according to claim 1, wherein the first and second levels can be stored flat when empty of gasified liquid and gas with a thickness of less than 5 cm.

5. The system according to claim 4, wherein the first connection part and/or the second connection part further comprises a first rod extending from said first base in the second direction, said first rod being configured to prevent sealing contact between said first base and said first shoulder once the first connection part is connected to said third connection part.

6. The system according to claim 4, wherein said first and second non-return connection parts are integrated.

7. The system according to claim 1, wherein the first connection part and/or the second connection part further comprises a first rod extending from said first base in the second direction, said first rod being configured to prevent sealing contact between said first base and said first shoulder once the first connection part is connected to said third connection part.

8. The system according to claim 7, wherein said first and second non-return connection parts are integrated.

9. The system according to claim 1, wherein said first and second non-return connection parts are integrated.

10. The system according to claim 1, further comprising an envelope configured to hold said first and second levels in a maximum volume, said envelope being configured to be stored flat.

11. The system according to claim 10, wherein said envelope is configured to be stored flat with a thickness of less than 5 cm.

12. The system according to claim 10, wherein said envelope has an opening for the passage of the first non-return connection part and/or the second non-return connection part.

13. The system according to claim 10, wherein said envelope is detachable from said first and second levels.

14. The system according to claim 10, wherein said envelope has an opening for the introduction and extraction of said first and second levels.

15. The system according to claim 14, wherein said opening is reversible in opening and closing.

16. The system according to claim 1, wherein the first storage level is contained in the second storage level.

17. The system according to claim 1, wherein the first and second levels are juxtaposed.

18. The system according to claim 17, wherein the first and second levels have a common wall.

19. The system according to claim 1, configured to contain a gasified liquid and wherein the first level is configured to store the gasified liquid so as to retain the gaseous properties of said gasified liquid.

* * * * *